US008723593B2

(12) United States Patent
Inoue

(10) Patent No.: US 8,723,593 B2
(45) Date of Patent: May 13, 2014

(54) BIAS VOLTAGE GENERATION CIRCUIT AND DIFFERENTIAL CIRCUIT

(71) Applicant: Fumihiro Inoue, Tokyo (JP)

(72) Inventor: Fumihiro Inoue, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 13/767,957

(22) Filed: Feb. 15, 2013

(65) Prior Publication Data

US 2013/0241632 A1 Sep. 19, 2013

(30) Foreign Application Priority Data

Mar. 14, 2012 (JP) ..... 2012-057887

(51) Int. Cl.
*G05F 1/10* (2006.01)

(52) U.S. Cl.
USPC ..... 327/538

(58) Field of Classification Search
USPC ..... 323/315; 327/534, 535, 537, 538, 543, 327/563
See application file for complete search history.

(56) References Cited

U.S. PATENT DOCUMENTS 5,594,383 A 1/1997 Tamba
5,835,994 A * 11/1998 Adams ..... 323/315
8,063,624 B2 * 11/2011 Ribeiro Do Nascimento et al. ..... 323/315

FOREIGN PATENT DOCUMENTS

JP 7-212185 8/1995

* cited by examiner

*Primary Examiner* — Jeffrey Zweizig
(74) *Attorney, Agent, or Firm* — IPUSA, PLLC

(57) ABSTRACT

A bias voltage generation circuit includes a first current source connected to a first power source; a first transistor which is diode connected and is connected to the first current source; a second transistor connected between the first transistor and a second power source; a second current source connected to the first power source; a third transistor connected to the second current source; a fourth transistor connected between the third transistor and the second power source; a first output point connected to the first transistor and the third transistor and outputs a first bias voltage; a second output point connected to the fourth transistor and the second current source and outputs a second bias voltage; and a bias voltage adjusting circuit which adjusts the first bias voltage in accordance with a control input.

4 Claims, 4 Drawing Sheets

BIAS VOLTAGE GENERATION CIRCUIT AND DIFFERENTIAL CIRCUIT

BACKGROUND OF THE INVENTION

1. Field of the Invention

The present invention relates to a bias voltage generation circuit and a differential circuit including the bias voltage generation circuit.

2. Description of the Related Art

In Patent Document 1, a bias circuit which adjusts a bias voltage to be applied to a gate of a constant current type load MOSFET such that an input differential MOSFET which composes a differential circuit does not become non-saturated even when a bias current of the differential circuit varies.

PATENT DOCUMENT

[Patent Document 1] Japanese Laid-open Patent Publication No. H07-212185

However, if the differential circuit includes cascode connections, the margin of the operating voltage of each of the transistors constituting the differential circuit is lowered when the bias current of the differential circuit varies so that it is difficult for the differential circuit to perform a necessary function. For example, when the margin is lowered, it may be difficult to retain the operating point in which each of the transistors constituting the differential circuit can be operated at a saturation region and to retain the output voltage range of the differential circuit.

SUMMARY OF THE INVENTION

The present invention is made in light of the above problems, and provides a bias voltage generation circuit and a differential circuit including the bias voltage generation circuit capable of having the differential circuit including cascade connections perform the function of the differential circuit.

According to an embodiment, there is provided a bias voltage generation circuit which generates a bias voltage to be supplied to a current source of a differential circuit through which a variable bias current flows, including: a first current source one end of which is connected to a first power source; a first transistor which is diode connected and is connected to the other end of the first current source; a second transistor which is connected between the first transistor and a second power source and includes a control electrode connected to a control electrode of the first transistor; a second current source one end of which is connected to the first power source; a third transistor which is connected to the other end of the second current source; a fourth transistor which is connected between the third transistor and the second power source and includes a control electrode connected to the second current source; a first output point which is connected to the control electrode of the first transistor and a control electrode of the third transistor and outputs a first bias voltage; a second output point which is connected to the control electrode of the fourth transistor and the second current source and outputs a second bias voltage; and a bias voltage adjusting circuit which adjusts the first bias voltage in accordance with a control input.

According to another embodiment, there is provided a bias voltage generation circuit which generates a bias voltage to be supplied to a current source of a differential circuit through which a variable bias current flows, including: a first current source one end of which is connected to a first power source; a resistor one end of which is connected to the other end of the first current source; a first transistor one end of which is connected to the other end of the resistor; a second transistor one end of which is connected to the other end of the first transistor and the other end of which is connected to a second power source; a first output point which is connected to the one end of the resistor and a control electrode of the first transistor and outputs a first bias voltage; a second output point which is connected to the other end of the resistor and a control electrode of the second transistor and outputs a second bias voltage; and a bias voltage adjusting circuit which adjusts the first bias voltage and the second bias voltage in accordance with a control input.

According to another embodiment, there is provided a differential circuit including the above bias voltage generation circuit; and an active load which is cascode connected and is controlled by the first bias voltage and the second bias voltage.

BRIEF DESCRIPTION OF THE DRAWINGS

Other objects, features and advantages of the present invention will become more apparent from the following detailed description when read in conjunction with the accompanying drawings.

Figure 1:
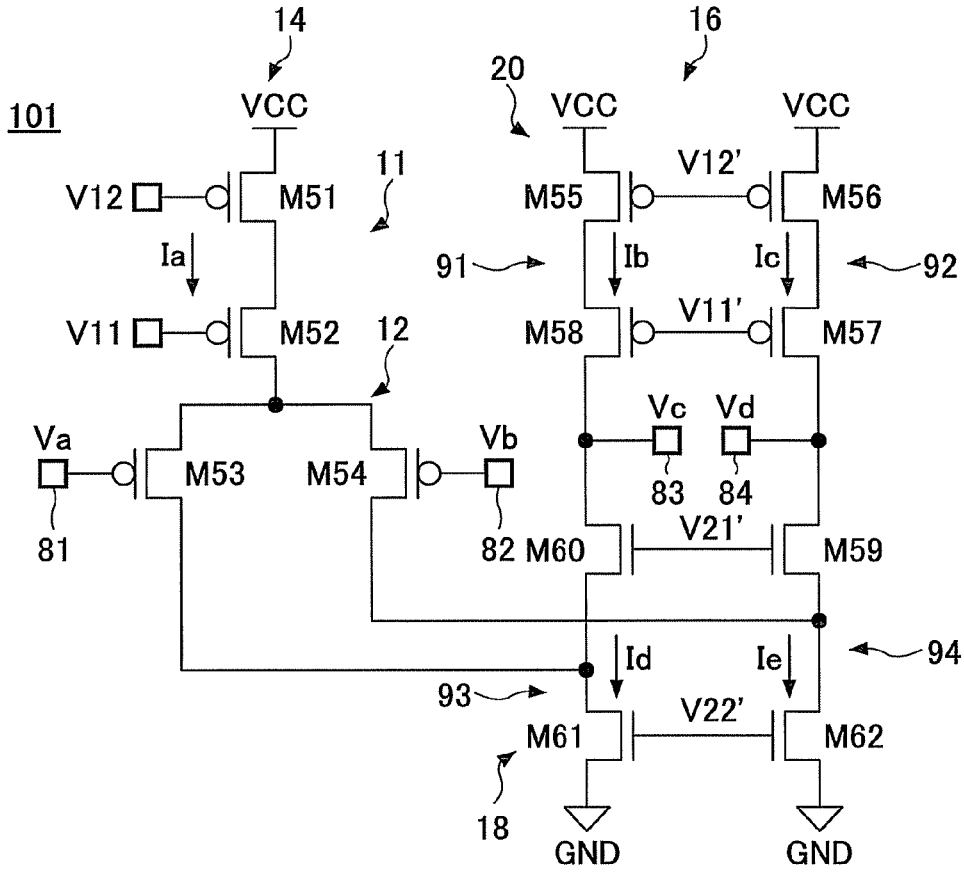
FIG. 1 is a view showing an example of an operational amplifier, which is an example of a differential circuit.

Note that also arbitrary combinations of the above-described constituents, and any exchanges of expressions in the present invention, made among methods, devices and so forth, are valid as embodiments of the present invention.

DETAILED DESCRIPTION OF THE PREFERRED EMBODIMENTS

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

In the drawings, a transistor with a circle at its gate indicates a P channel MOSFET, and a transistor without a circle at its gate indicates an N channel MOSFET.

FIG. 1 is a view showing an example of a structure of an operational amplifier 101 which is a first example of a differential circuit. The operational amplifier 101 is a differential input-differential output type folded operational amplifier circuit and is integrated in a semiconductor integrated circuit including a complementary metal oxide semiconductor (CMOS). The operational amplifier 101 is a differential circuit through which a variable bias current Ia flows. The operational amplifier 101 includes a P channel differential input circuit 14, and a differential output circuit 16 connected to the differential input circuit 14.

The differential input circuit 14 includes a bias current source 11 including transistors M51 and M52 and a differential input pair 12 including a pair of transistors M53 and M54. The bias current source 11 is provided with a source voltage VCC of a positive electrode side (high-voltage side) and supplies the bias current Ia to be input into the differential input pair 12.

A bias voltage V12 is input to the gate of the transistor M51, and a bias voltage V11 is input to the gate of the transistor M52. The bias current source 11 is a cascode current source which supplies the bias current Ia in accordance with the bias voltages V12 and V11 by the transistors M51 and M52 to the differential input pair 12. The bias current source 11 is cascade connected to a common source of the differential input pair 12 as an active load controlled by the bias voltages V12 and V11.

The transistor M52 is a cascode element which is cascode connected between the transistor M51 and the differential input pair 12. By inputting the bias voltage V11 to the gate of the transistor M52, the output impedance of the transistor M51 of the bias current source 11 can be increased.

The differential input pair 12 is respectively connected to differential input terminals 81 and 82 of the operational amplifier 101. The gate of the transistor M53 is connected to the noninverting input terminal 81 to which an input voltage Va is input, and the gate of the transistor M54 is connected to the inverting input terminal 82 to which an input voltage Vb is input. The sources of the transistors M53 and M54 are connected with each other and are connected to the drain of the transistor M52 of the bias current source 11. The drains of the transistors M53 and M54 of the differential input pair 12 are connected to an NMOS cascode current source 18 of the differential output circuit 16.

The differential output circuit 16 includes a PMOS cascode current source 20 and the NMOS cascode current source 18 as active loads. The PMOS cascade current source 20 is provided between a terminal to which a source voltage VCC of a positive electrode side (high-voltage side) is input and a pair of differential output terminals 83 and 84 of the operational amplifier 101. The NMOS cascode current source 18 is provided between a terminal to which a source voltage GND of a negative electrode side (low-voltage side) is provided and the pair of differential output terminals 83 and 84 of the operational amplifier 101.

The PMOS cascode current source 20 and the NMOS cascode current source 18 respectively include plural cascode circuits each of which are composed of plural cascade elements which are cascode connected with each other. The PMOS cascode current source 20 includes a cascode circuit 91 including transistors M55 and M58, and a cascade circuit 92 including transistors M56 and M57. The NMOS cascode current source 18 includes a cascade circuit 93 including transistors M60 and M61, and a cascade circuit 94 including transistors M59 and M62.

The cascode circuit 91 is connected between the terminal to which the source voltage VCC is input and the differential output terminal 83 of the operational amplifier 101 and supplies an output current Ib to the differential output terminal 83. A bias voltage V12' is input to the gate of the transistor M55, and a bias voltage V11' is input to the gate of the transistor M58. The cascode circuit 91 is a cascade current source which supplies the output current Ib in accordance with the bias voltages V12' and V11' to the differential output terminal 83 by the transistors M55 and M58. The cascade circuit 91 is cascade connected to the differential output terminal 83 as an active load controlled by the bias voltages V12' and V11'.

The transistor M58 is a cascade element which is cascade connected between the transistor M55 and the differential output terminal 83. By inputting the bias voltage V11' to the gate of the transistor M58, the output impedance of the transistor M55 of the cascade circuit 91 can be increased.

Similarly, the cascode circuit 92 is connected between the terminal to which the source voltage VCC is input and the differential output terminal 84 of the operational amplifier 101 and supplies an output current Ic to the differential output terminal 84. The bias voltage V12' is input to the gate of the transistor M56, and the bias voltage V11' is input to the gate of the transistor M57. The cascode circuit 92 is a cascade current source which supplies the output current Ic in accordance with the bias voltages V12' and V11' to the differential output terminal 84 by the transistors M56 and M57. The cascade circuit 92 is cascade connected to the differential output terminal 84 as an active load controlled by the bias voltages V12' and V11'.

The transistor M57 is a cascode element which is cascade connected between the transistor M56 and the differential output terminal 84. By inputting the bias voltage V11' to the gate of the transistor M57, the output impedance of the transistor M56 of the cascode circuit 92 can be increased.

The cascode circuit 93 is connected between a terminal to which the source voltage GND is input and the differential output terminal 83 of the operational amplifier 101 and supplies an output current Id to the differential output terminal 83. A bias voltage V22' is input to the gate of the transistor M61, and a bias voltage V21' is input to the gate of the transistor M60. The cascode circuit 93 is a cascode current source which supplies the output current Id in accordance with the bias voltages V22' and V21' to the differential output terminal 83 by the transistors M61 and M60. The cascode circuit 93 is cascode connected to the differential output terminal 83 as an active load controlled by the bias voltages V22' and V21'.

The transistor M60 is a cascode element which is cascode connected between the transistor M61 and the differential output terminal 83. By inputting the bias voltage V21' to the gate of the transistor M60, the output impedance of the transistor M61 of the cascade circuit 93 can be increased.

The drain of the transistor M61 is connected to the drain of the transistor M53 and the source of the transistor M60. Here, the output current Id is a sum of a current obtained by dividing the bias current Ia supplied from the bias current source 11 by the differential input pair 12 and a current supplied from the cascode circuit 91. The bias voltage V22' is supplied between the gate-source of the transistor M61 for flowing the output current Id. The bias current Ia is divided by the differential input pair 12 based on the current value ratio (the numbers of transistors) of the transistors M53 and M54 which compose the current value ratio of the transistors M53 and M54 are 1:1, the bias current Ia is divided into half.

Similarly, the cascode circuit 94 is connected between a terminal to which the source voltage GND is input and the differential output terminal 84 of the operational amplifier 101 and supplies an output current Ie to the differential output terminal 84. The bias voltage V22' is input to the gate of the transistor M62, and the bias voltage V21' is input to the gate of the transistor M59. The cascode circuit 94 is a cascode current source which supplied the output current Ie in accordance with the bias voltages V22' and V21' by the transistors M62 and M59 to the differential output terminal 84. The cascode circuit 94 is cascode connected to the differential output terminal 84 as an active load controlled by the bias voltages V22' and V21'.

The transistor M59 is a cascode element which is cascode connected between the transistor M62 and the differential output terminal 84. By inputting the bias voltage V21' to the gate of the transistor M59, the output impedance of the transistor M62 of the cascode circuit 94 can be increased.

The drain of the transistor M62 is connected to the drain of the transistor M54 and the source of the transistor M59. Here, the output current Ie is a sum of a current obtained by dividing the bias current Ia supplied from the bias current source 11 by the differential input pair 12 and a current supplied from the cascode circuit 92. The bias voltage V22' is supplied between the gate-source of the transistor M62 for flowing the output current Ie. The bias current Ia is divided by the differential input pair 12 based on the current value ratio (the numbers of transistors) of the transistors M53 and M54 which compose the current value ratio of the transistors M53 and M54 are 1:1, the bias current Ia is divided into half.

Figure 2:
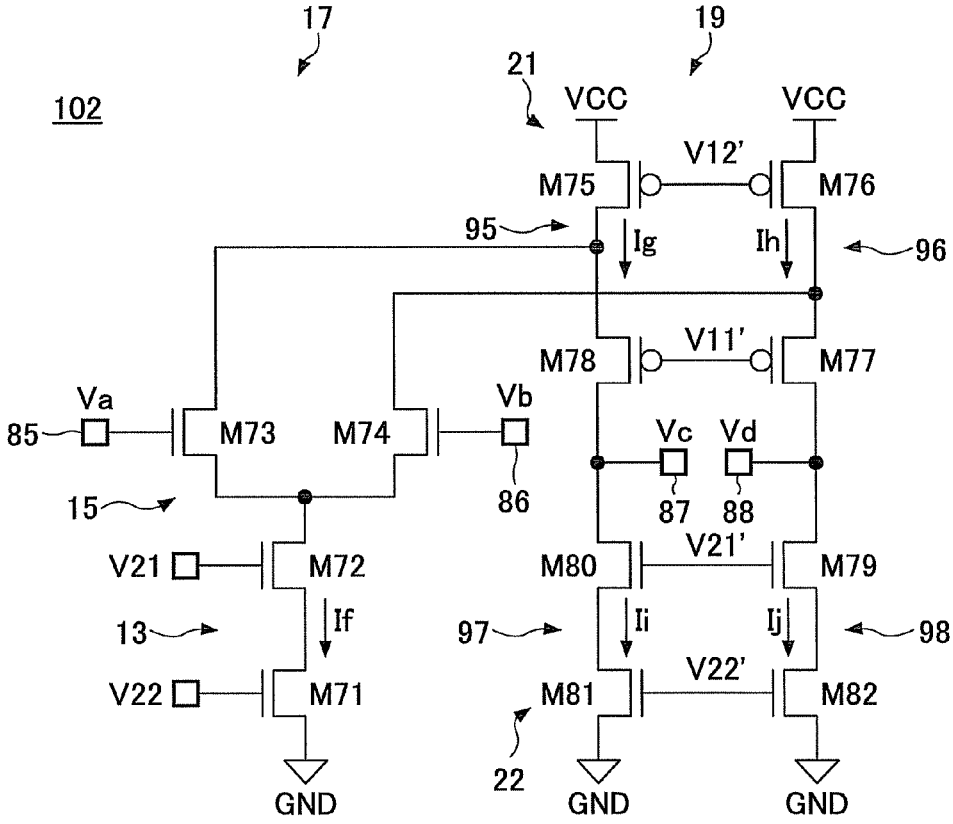
FIG. 2 is a view showing another example of the operational amplifier, which is an example of the differential circuit.

FIG. 2 is a view showing an example of a structure of an operational amplifier 102 which is a second example of the differential circuit. The operational amplifier 102 is a differential circuit through which a variable bias current If flows. The operational amplifier 102 includes an N channel differential input circuit 17 and a differential output circuit 19 connected to the differential input circuit 17. As can be understood from the drawings, the operational amplifier 102 of FIG. 2 has a structure similar to the operational amplifier 101 of FIG. 1 which is turned over, and the same explanation is not repeated in the following.

A bias current source 13 is a cascode current source which supplies the bias current If in accordance with the bias voltages V22 and V21 by the transistors M71 and M72 to a differential input pair 15. The bias current source 13 is cascade connected to the common source of the differential input pair 15 as an active load controlled by the bias voltages V22 and V21. The differential input pair 15 is connected to differential input terminals 85 and 86 of the operational amplifier 102.

The differential output circuit 19 includes a PMOS cascade current source 21 including cascade circuits 95 and 96, and an NMOS cascade current source 22 including cascade circuits 97 and 98 as active loads.

The cascode circuit 95 is a cascade current source which supplies an output current Ig in accordance with the bias voltages V12' and V11' to a differential output terminal 87 by transistors M75 and M78. The cascode circuit 96 is a cascade current source which supplies an output current Ih in accordance with the bias voltages V12' and V11' to a differential output terminal 88 by transistors M76 and M77. The cascade circuits 95 and 96 are cascade connected to the differential output terminals 87 and 88 as active loads controlled by the bias voltages V12' and V11'.

The cascade circuit 97 is a cascade current source which supplies an output current Ii in accordance with the bias voltages V22' and V21' to the differential output terminal 87 by transistors M81 and M80. The cascade circuit 98 is a cascade current source which supplies an output current Ij in accordance with the bias voltages V22' and V21' to the differential output terminal 88 by transistors M82 and M79. The cascode circuits 97 and 98 are cascode connected to the differential output terminals 87 and 88 as active loads controlled by the bias voltages V22' and V21'.

Then, a structure of a bias voltage generation circuit which generates the bias voltage which is to be supplied to the current source of the differential circuit through which the variable bias current flows is explained.

Figure 3:
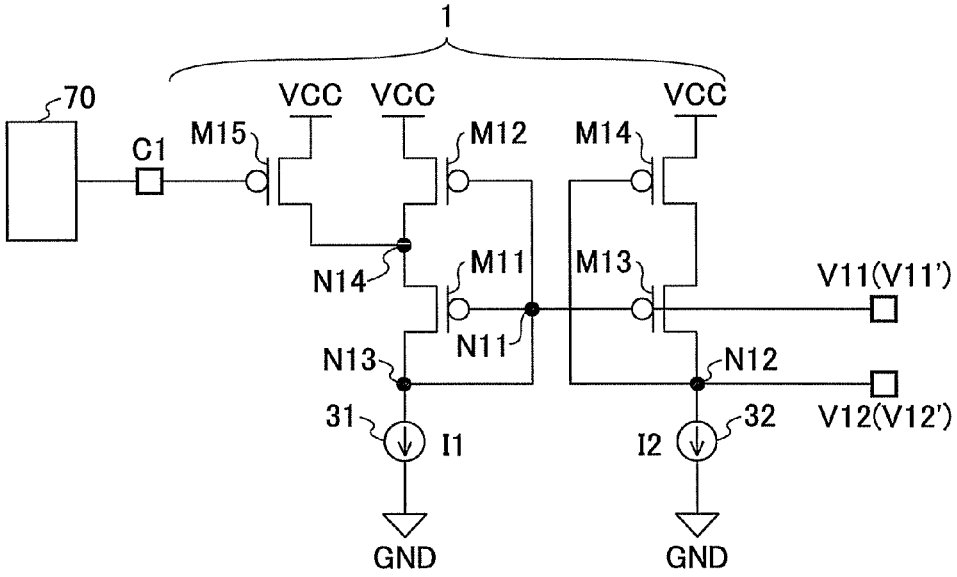
FIG. 3 is a view showing an example of a bias voltage generation circuit for the operational amplifier.

FIG. 3 is a view showing an example of a bias circuit 1 capable of generating the bias voltages V11, V11', V12 and V12'. The bias circuit 1 may be structured as an internal circuit of the operational amplifier 101 or 102 shown in FIG. 1 or FIG. 2, respectively, or may be structured as an external circuit of the operational amplifier 101 or 102 shown in FIG. 1 or FIG. 2, respectively. The bias circuit 1 includes a first current source 31, a first transistor M11, a second transistor M12, a second current source 32, a third transistor M13, a fourth transistor M14, a first node N11 and a second node N12.

The low-voltage side end of the first current source 31 is connected to the source voltage GND to generate a bias current I1 which sets the bias voltage V11 (or may be the bias voltage V11') to a predetermined voltage value.

The first transistor M11 includes the drain connected to the high-voltage side end of the first current source 31 via a node N13 as a first main electrode, the source connected to the drain of the second transistor M12 via a node N14 as a second main electrode, and the gate connected to the node N13 as a control electrode. In other words, the first transistor M11 is diode connected.

The second transistor M12 is connected between the source of the first transistor M11 and the source voltage VCC and includes the gate connected to the gate of the first transistor M11 as a control electrode.

The low-voltage side end of the second current source 32 is connected to the source voltage GND and generates a bias current I2 to set the bias voltage V12 (or may be the bias voltage V12') to a predetermined voltage value.

The third transistor M13 includes the drain connected to the high-voltage side end of the second current source 32 via the second node N12 as a first main electrode, the source connected to the drain of the fourth transistor M14 as a second main electrode, and the gate connected to the gate of the first transistor M11 as a control electrode.

The fourth transistor M14 is connected between the source of the third transistor M13 and the source voltage VCC, and includes the gate connected to the high-voltage side end of the second current source 32 via the second node N12 as a control electrode.

The first node N11 is a first output point which is connected to the gate of the first transistor M11 and the gate of the third transistor M13 and outputs the bias voltages V11 and/or V11'. The second node N12 is a second output point which is connected to the gate of the fourth transistor M14 and the high-voltage side end of the second current source 32 and outputs the bias voltages V12 and/or V12'.

Figure 4:
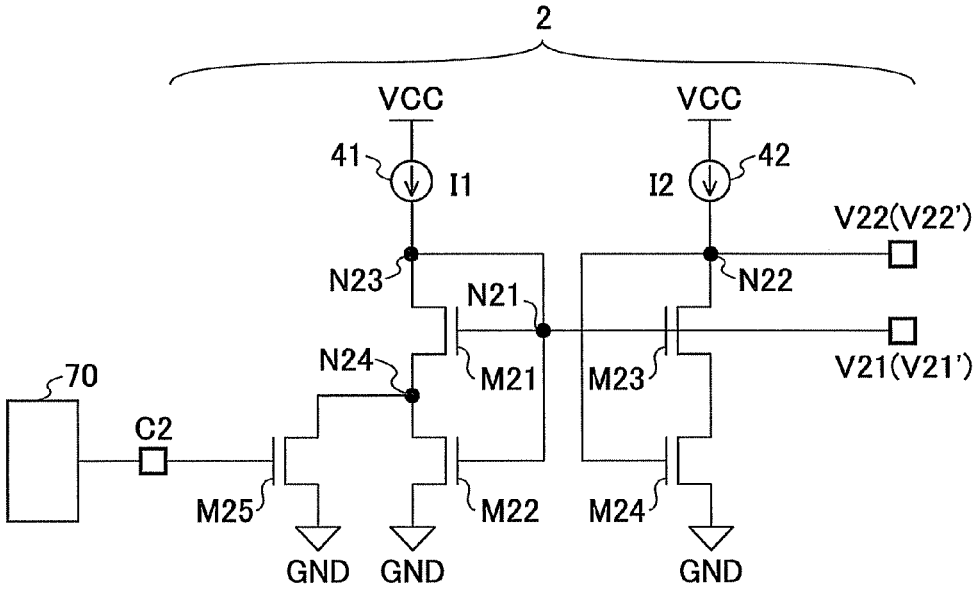
FIG. 4 is a view showing another example of the bias voltage generation circuit for the operational amplifier.

FIG. 4 is a view showing an example of a bias circuit 2 capable of generating the bias voltages V21, V21', V22 and V22'. The bias circuit 2 may be structured as an internal circuit of the operational amplifier 101 or 102 shown in FIG. 1 or FIG. 2, respectively, or may be structured as an external circuit of the operational amplifier 101 or 102 shown in FIG. 1 or FIG. 2, respectively. The bias circuit 2 includes a third current source (an example of a first current source), a fifth transistor M21 (an example of a first transistor), a sixth transistor M22 (an example of a second transistor), a fourth current source 42 (an example of a second current source), a seventh transistor M23 (an example of a third transistor), a eighth transistor M24 (an example of a fourth transistor), a third node N21 and a fourth node N22.

The high-voltage side end of the third current source 41 is connected to the source voltage VCC to generate a bias current I1 for setting the bias voltage V21 (or may be the bias voltage V21') to a predetermined voltage value. The current value of the bias current I1 generated by the third current source 41 may be the same as or different from the current value of the bias current I1 generated by the first current source (see FIG. 3).

The fifth transistor M21 (an example of a first transistor) includes the drain connected to the low-voltage side end of the third current source 41 via the node N23 as a first main electrode, the source connected to the drain of the sixth transistor M22 via a node N24 as a second main electrode, and the gate connected to a node N23 as a control electrode. It means that the fifth transistor M21 is diode connected.

The sixth transistor M22 (an example of a second transistor) is connected between the source of the fifth transistor M21 and the source voltage GND and includes the gate connected to the gate of the fifth transistor M21 as a control electrode.

The high-voltage side end of the fourth current source 42 (an example of a second current source) is connected to the source voltage VCC and generates a bias current I2 for setting the bias voltage V22 (or may be the bias voltage V22') to a predetermined voltage value. The current value of the bias current I2 generated by the fourth current source 42 may be the same as or different from the current value of the bias current I2 generated by the second current source 32 (see FIG. 3).

The seventh transistor M23 (an example of a third transistor) includes the drain connected to the low-voltage side end of the fourth current source 42 via the fourth node N22 as a first main electrode, the source connected to the drain of the eighth transistor M24 as a second main electrode, and the gate connected to the gate of the fifth transistor M21 as a control electrode.

The eighth transistor M24 (an example of a fourth transistor) is connected between the source of the seventh transistor M23 and the source voltage GND and includes the gate connected to the low-voltage side end of the fourth current source 42 via the fourth node N22 as a control electrode.

The third node N21 is a first output point which is connected to the gate of the fifth transistor M21 and the gate of the seventh transistor M23 and outputs the bias voltages V21 and/or V21'. The fourth node N22 is a second output point which is connected to the gate of the eighth transistor M24 and the low-voltage side end of the fourth current source 42 and outputs the bias voltages V22 and/or V22'.

Thus, according to the bias circuit 1 shown in FIG. 3, the voltage values of the bias voltages V11 and V11' can be set in accordance with the current value of the bias current I1 generated by the first current source 31. The voltage values of the bias voltages V12 and V12' can be set in accordance with the current value of the bias current I2 generated by the second current source 32. Further, according to the bias circuit 2 shown in FIG. 4, the voltage values of the bias voltages V21 and V21' can be set in accordance with the current value of the bias current I1 generated by the third current source 41. The voltage values of the bias voltages V22 and V22' can be set in accordance with the current value of the bias current I2 generated by the fourth current source 42.

With this structure, by increasing or decreasing the current values of the bias currents I1 and I2 in accordance with the operational mode of the operational amplifier 101 (or may be the operational amplifier 102), the current sources 31, 32, 41 and 42 can vary the bias current Ia or If and the output currents Ib to Ie or Ig to Ij (see FIG. 1 or FIG. 2), respectively, to the current values suitable for the operational mode. By increasing and decreasing the current values of the bias current Ia or If and the output currents Ib to Ie or Ig to Ij, for example, the frequency characteristic of the operational amplifier 101 or 102 can be varied to a desired characteristic. By reducing the bias currents I1 and I2, the consumption current of the bias circuit 1 or 2 can be reduced. As a result, the bias current Ia or If, and the output currents Ib to Ie or Ig to Ij are reduced so that the consumption current of the operational amplifier 101 or 102 can be reduced.

When the bias currents I1 and I2 increase or decrease, the bias voltages to be supplied to the transistors composing the operational amplifiers 101 and 102, respectively, vary so that the operating point of each of the transistors varies. As a result, there is a possibility that the values of the bias voltages V11, V11', V21 and V21' supplied to the gates of the cascode elements M52, M58, M57, M59, M60, M72, M78, M77, M79 and M80 shift from optimal values, respectively, for example.

Thus, the bias circuit 1 of FIG. 3 further includes a transistor M15 as a bias voltage adjusting circuit which adjusts the bias voltages V11 and V11' supplied to the gates of the cascode elements M52, M57, M58, M77 and M78 in accordance with the control input C1 supplied from a control unit 70. Similarly, the bias circuit 2 of FIG. 4 further includes a transistor M25 as a bias voltage adjusting circuit which adjusts the bias voltages V21 and V21' supplied to the gates of the cascode elements M59, M60, M72, M79 and M80 in accordance with the control input C2 supplied from a control unit 70.

For the case of FIG. 3, the control unit 70 is a control circuit which outputs the control input C1 to the gate of the transistor M15 in accordance with the operational mode of the operational amplifier 101 set in the resister, for example. The control input C1 is switched in accordance with the variance of the current value of the bias current Ia of the operational amplifier 101. The control unit 70 lowers the bias current Ia by decreasing the bias currents I1 and I2 as well as switching off the transistor M15 by the control input C1 when the operational mode of the operational amplifier 101 is a mode capable of lowering the bias current Ia, for example. The control unit 70 can fine adjust the voltage value of the bias voltage V11 or V11' by switching off the transistor M15 by the control input C1 to be a lower value compared with a case when the transistor M15 is switched on. With this, the increase of the voltage value of the bias voltage V11 or V11' due to the decrease of the bias currents I1 and I2 can be compensated.

The transistor M15 is a short circuit which shorts the node N14 to which the source of the first transistor M11 and the drain of the second transistor M12 are connected to the source voltage VCC in accordance with the control input C1. The transistor M15 is a switch element including the drain connected to the node N14 as a first main electrode and the source connected to the source voltage VCC as a second main electrode.

For the case of FIG. 4, the control unit 70 is, for example, a control circuit which outputs the control input C2 to the gate of the transistor M25 in accordance with the operational mode of the operational amplifier 102 set in the resister. The control input C2 is switched in accordance with the variance of the current value of the bias current If of the operational amplifier 102. The control unit 70 lowers the bias current If by decreasing the bias currents I1 and I2 as well as switching off the transistor M25 by the control input C2 when the operational mode of the operational amplifier 102 is at a mode capable of lowering the bias current If, for example. The control unit 70 can fine adjust the voltage value of the bias voltage V21 or V21' by switching off the transistor M25 by the control input C2 to be a higher value compared with a case when the transistor M25 is switched on. With this, the decrease of the voltage values of the bias voltage V21 or V21' due to the increase of the bias currents I1 and I2 can be compensated.

The transistor M25 is a short circuit which shorts the node N24 to which the source of the fifth transistor M21 and the drain of the sixth transistor M22 are connected to the source voltage GND in accordance with the control input C2. The transistor M25 is a switch element including the drain connected to the node N24 as a first main electrode and the source connected to the source voltage GND as a second main electrode.

For example, in FIG. 4, when the bias voltage V21 or V21' decreases due to the decrease of the bias current I1 and the voltage between the drain and the source of the eighth transistor M24 decreases, the operating voltage margin of the eighth transistor M24 decreases so that there is a possibility that a phenomenon in which the eighth transistor M24 is operated at a triode region to decrease the output resistor. On the other hand, when the bias voltage V21 or V21' increases due to the increase of the bias current I1, the operating voltage margin of the seventh transistor M23 decreases so that there is a possibility that a phenomenon in which the output voltage range of the operational amplifier 102 decreases. As these phenomenons cause decreasing of the output resistor and the gain of the operational amplifier 102, it is difficult for the operational amplifier 102 to perform a desired function of the operational amplifier.

However, according to the bias circuit 1 of FIG. 3 or the bias circuit 2 of FIG. 4, the bias voltages V11, V11', V21 and V21' supplied to the cascade elements M52, M58, M57, M59, M60, M72, M78, M77, M79 and M80 can be adjusted by the transistor M15 or M25. Thus, the transistors composing the operational amplifier 101 or 102 can be operated at saturation regions, respectively, and the operational amplifier 101 or 102 can perform a desired function of the operational amplifier.

Another example of the bias voltage generation circuit is explained.

Figure 5:
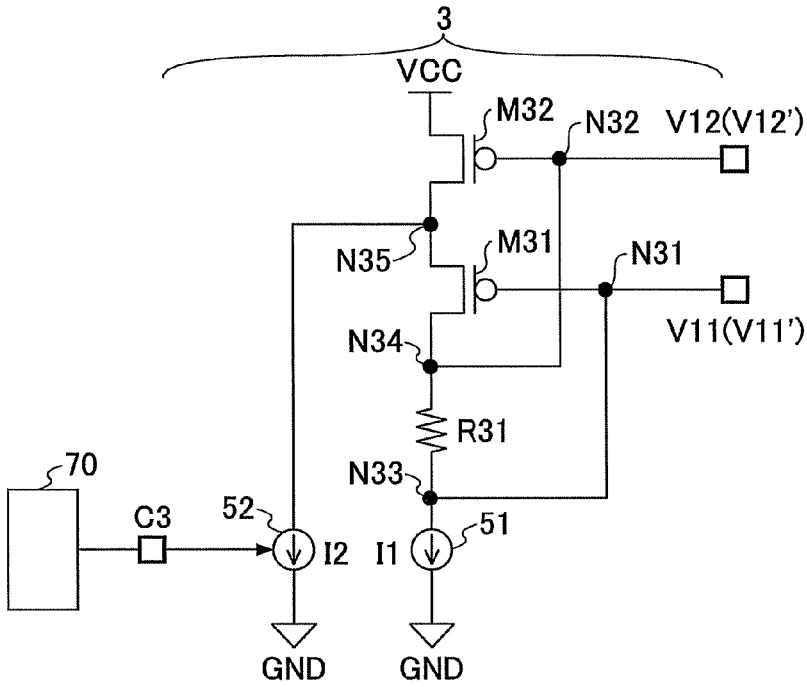
FIG. 5 is a view showing another example of the bias voltage generation circuit for the operational amplifier.

FIG. 5 is a view showing an example of a bias circuit 3 capable of generating the bias voltages V11, V11', V12 and V12'. The bias circuit 3 may be structured as an internal circuit of the operational amplifier 101 or 102, or may be structured as an external circuit of the operational amplifier 101 or 102. The bias circuit 3 includes a current source 51 (an example of a first current source), a resistor R31, a transistor M31 (an example of a first transistor), a transistor M32 (an example of a second transistor), a node N33 (an example of a first node), a node N34 (an example of a second node) and a current source 52 (an example of a second current source).

The low-voltage side end of the current source 51 is connected to the source voltage GND and generates a bias current I1 for setting the bias voltages V11 and V12 (or may be the bias voltages V11' and V12') to be a predetermined voltage value.

The resistor R31 is a fixed resistor whose low-voltage side end is connected to the high-voltage side end of the current source 51 via the node N33.

The transistor M31 includes the drain connected to the high-voltage side end of the resistor R31 via the node N34 as a first main electrode, the source connected to the drain of the transistor M32 via the node N35 as a second main electrode, and the gate connected to the node N33 as a control electrode.

The transistor M32 includes the drain connected to the source of the transistor M31 via the node N35 as a first main electrode, the source connected to the source voltage VCC as a second main electrode, and the gate connected to the node N34 as a control electrode.

The node N31 is a first output point which is connected to the gate of the transistor M31 and the node N33 and outputs the bias voltage V11 or V11'. The node N32 is a second output point which is connected to the gate of the transistor M32 and the node N34 and outputs the bias voltage V12 or V12'.

The current source 52 is a bias voltage adjusting circuit which adjusts the bias voltages V11 and V11', V12 and V12' in accordance with the control input C3 supplied from a control unit 70. For the case shown in FIG. 5, the current source 52 is a current source circuit which is connected to the node N35 in accordance with the control input C3. When the current source 52 is connected to the node N35, the bias current I2 generated by the current source 52 is applied to the node N35.

Figure 6:
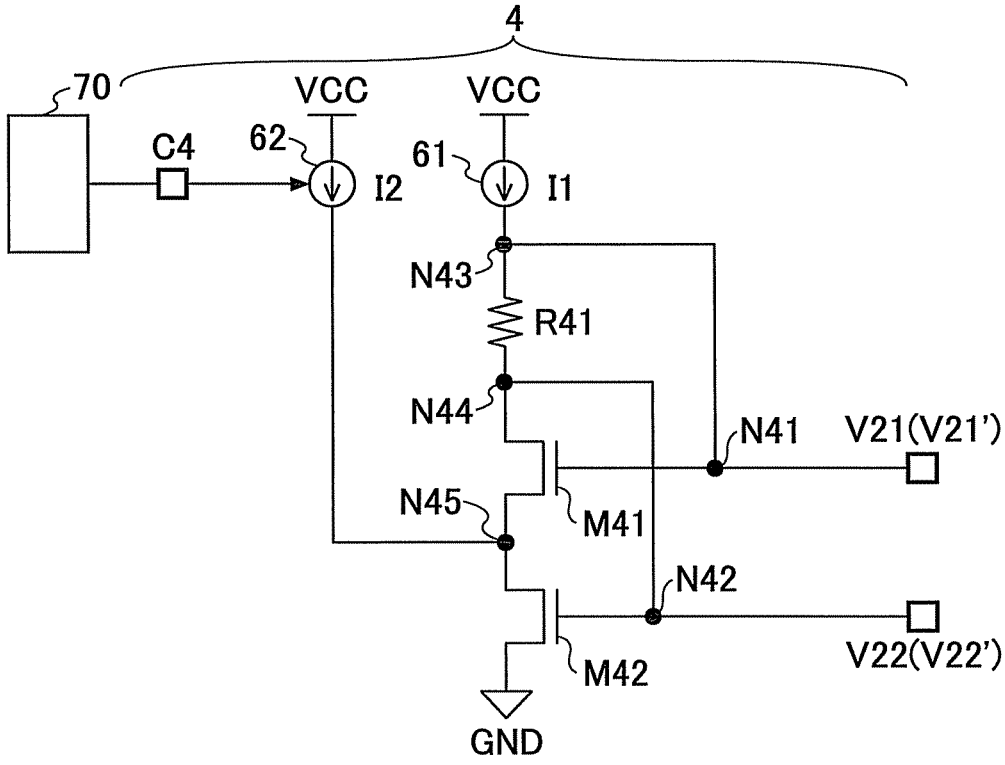
FIG. 6 is a view showing another example of the bias voltage generation circuit for the operational amplifier.

FIG. 6 is a view showing an example of a bias circuit 4 capable of generating the bias voltages V21, V21', V22 and V22'. The bias circuit 4 may be structured as an internal circuit of the operational amplifier 101 or 102, or may be structured as an external circuit of the operational amplifier 101 or 102. The bias circuit 4 includes a current source 61 (an example of a first current source), a resistor R41, a transistor M41 (an example of a first transistor), a second transistor M42, a node N43 (an example of a first node), a node N44 (an example of a second node) and a current source 62 (an example of a second current source).

The high-voltage side end of the current source 61 is connected to the source voltage VCC and generates a bias current I1 for setting the bias voltages V21 and V22 (or may be the bias voltages V21' and V22') to be a predetermined voltage value.

The resistor R41 is a fixed resistor whose high-voltage side end is connected to the low-voltage side end of the current source 61 via the node N43.

The transistor M41 includes the drain connected to the low-voltage side end of the resistor R41 via the node N44 as a first main electrode, the source connected to the drain of the transistor M42 via the node N45 as a second main electrode and the gate connected to the node N43 as a control electrode.

The transistor M42 includes the drain connected to the source of the transistor M41 via the node N45 as a first main electrode, the source connected to the source voltage GND as a second main electrode and the gate connected to the node N44 as a control electrode.

The node N41 is a first output point which is connected to the gate of the transistor M41 and the node N43 and outputs the bias voltage V21 or V21'. The node N42 is a second output point which is connected to the gate of the transistor M42 and the node N44 and outputs the bias voltage V22 or V22'.

The current source 62 is a bias voltage adjusting circuit which adjusts the bias voltages V21, V21', V22 and V22' in accordance with the control input C4 supplied from a control unit 70. For the case shown in FIG. 6, the current source 62 is a current source circuit which is connected to the node N45 in accordance with the control input C4. When the current source 62 is connected to the node N45, the bias current I2 generated by the current source 62 is applied to the node N45.

Thus, according to the bias circuit 3 of FIG. 5, the voltage values of the bias voltages V11, V11', V12 and V12' can be set in accordance with the current values of the bias currents I1 and I2. It means that the bias voltages V12 and V12' can be set based on the sum of the bias currents I1 and I2, the bias voltages V11 and V11' can be set based on the sum of the product of the bias current I1 and the resistor R31, and the bias voltages V12 and V12', respectively. Further, according to the bias circuit 4 of FIG. 6, the voltage values of the bias voltages V21, V21', V22 and V22' can be set in accordance with the current values of the bias currents I1 and I2. It means that the bias voltages V22 and V22' can be set based on the sum of the bias currents I1 and I2 and the bias voltages V21 and V21' can be set based on the sum of the product of the bias current I1 and the resistor R41, and the bias voltages V22 and V22', respectively.

With this structure, by switching the connection between the node N35 or N45 and the bias current I2 in accordance with the operational mode of the operational amplifier 101 (or may be operational amplifier 102), the control unit 70 can vary the bias current Ia or If and the output currents Ib to Ie or Ig to Ij (see FIG. 1 or FIG. 2), respectively, to the current values suitable for the operational mode. By increasing and decreasing the current values of the bias current Ia or If and the output currents Ib to Ie or Ig to Ij, for example, the frequency characteristic of the operational amplifier 101 or 102 can be changed to a desired characteristic. Further, the consumption current of the bias circuit 1 or 2 can be reduced by decreasing the bias currents I1 and I2. As a result, the bias current Ia or If and the output currents Ib to Ie or Ig to Ij are reduced so that the consumption current of the operational amplifier 101 or 102 can be reduced.

For the case of FIG. 5, the control unit 70 is a control circuit which outputs the control input C3 to the control input unit of the current source 52 in accordance with the operational mode of the operational amplifier 101 set in the resister, for example. The control input C3 is switched in accordance with the variance of the current value of the bias current Ia of the operational amplifier 101. The control unit 70 lowers the bias current Ia by disconnecting the bias current I2 and the node N35 by the control input C3 when the operational mode of the operational amplifier 101 is at a mode capable of lowing the bias current Ia, for example. The control unit 70 can fine adjust the voltage values of the bias voltages V12, V12', V11 and V11' by disconnecting the bias current I2 and the node N35 by the control input C3 to be a higher value compared with a case when the bias current I2 and the node N35 are connected.

For the case of FIG. 6, the control unit 70 is a control circuit which outputs the control input C4 to the control input unit of the current source 62 in accordance with the operational mode of the operational amplifier 102 set in the resister, for example. The control input C4 is switched in accordance with the variance of the current value of the bias current If of the operational amplifier 102. The control unit 70 lowers the bias current If by disconnecting the bias current I2 and the node N45 by the control input C4 when the operational mode of the operational amplifier 102 is at a mode capable of lowing the bias current If, for example. The control unit 70 can fine adjust the voltage values of the bias voltages V21, V21', V22 and V22' by disconnecting the bias current I2 and the node N45 by the control input C4 to be a lower value compared with a case when the bias current I2 and the node N45 are connected.

Thus, according to the bias circuit 3 or 4 of FIG. 5 or FIG. 6, respectively, the bias voltages V11, V11', V12, V12', V21, V21', V22 and V22' can be adjusted by the current source 52 or 62. Thus, the operational amplifier 101 or 102 can perform a desired function of the operational amplifier.

The present invention is not limited to the specifically disclosed embodiments, and variations and modifications may be made without departing from the scope of the present invention.

For example, in FIG. 1, the gates of the transistors M55 and M56 may be connected to the gate of the transistor M51. Further, the gates of the transistors M57 and M58 may be connected to the gate of the transistor M52. Further, in FIG. 2, the gates of the transistors M81 and M82 may be connected to the gate of the transistor M71. The gates of the transistors M79 and M80 may be connected to the gate of the transistor M72.

Further, although the differential input-differential output type folded operational amplifier circuit is exemplified above as an example of the differential circuit, the embodiment is not limited so. For example, the differential circuit of the embodiment may be a differential input-single ended output type folded operational amplifier circuit.

For example, in FIG. 1, by connecting the connecting point of the transistors M58 and M60 to the gate of the transistor M55, a current mirror circuit is formed. With this, a single ended output Vd is output from the output terminal 84. Further, by connecting the connecting point of the transistors M57 and M59 to the gate of the transistor M56, a current mirror circuit is formed. With this, a single ended output Vc is output from the output terminal 83. These may be applied for the structure in FIG. 2.

The operational amplifier 101 or 102 may be used for an integrator of a ΔΣ modulator in an AD converter, for example. At this time, the bias current Ia or If may be increased or decreased in accordance with the AD conversion speed (an example of the operational mode of the AD converter). When the operational mode is a mode at which the AD conversion speed is faster, the control unit 70 increases the bias current Ia or If as it is necessary to increase the frequency characteristic of the operational amplifier 101 or 102. On the other hand, when the operational mode is a mode at which the AD conversion speed is slower, the control unit 70 decreases the bias current Ia or If as the frequency characteristic of the operational amplifier 101 or 102 can be lowered. By decreasing the bias current Ia or If, the consumption current of the AD converter can be suppressed.

According to the embodiment, the function of the differential circuit including cascode connections can be appropriately performed.

Although a preferred embodiment of the bias voltage generation circuit and the differential circuit has been specifically illustrated and described, it is to be understood that minor modifications may be made therein without departing from the spirit and scope of the invention as defined by the claims.

The present invention is not limited to the specifically disclosed embodiments, and variations and modifications may be made without departing from the scope of the present invention.

The present application is based on Japanese Priority Application No. 2012-057887 filed on Mar. 14, 2012, the entire contents of which are hereby incorporated by reference.

What is claimed is:

1. A bias voltage generation circuit which generates a bias voltage to be supplied to a current source of a differential circuit through which a variable bias current flows, comprising:

a first current source one end of which is connected to a first power source;

a first transistor which is diode connected and is connected to the other end of the first current source;

a second transistor which is connected between the first transistor and a second power source and includes a control electrode connected to a control electrode of the first transistor;

a second current source one end of which is connected to the first power source;

a third transistor which is connected to the other end of the second current source;

a fourth transistor which is connected between the third transistor and the second power source and includes a control electrode connected to the second current source;

a first output point which is connected to the control electrode of the first transistor and a control electrode of the third transistor and outputs a first bias voltage;

a second output point which is connected to the control electrode of the fourth transistor and the second current source and outputs a second bias voltage; and a bias voltage adjusting circuit which adjusts the first bias voltage in accordance with a control input.

2. The bias voltage generation circuit according to claim 1, wherein the bias voltage adjusting circuit includes a short circuit which shorts a connecting point of the first transistor and the second transistor to the second power source in accordance with the control input.

3. The bias voltage generation circuit according to claim 1, wherein the control input is switched in accordance with the variance of the variable bias current.

4. A differential circuit comprising:

a bias voltage generation circuit that includes, a first current source one end of which is connected to a first power source, a first transistor which is diode connected and is connected to the other end of the first current source, a second transistor which is connected between the first transistor and a second power source and includes a control electrode connected to a control electrode of the first transistor, a second current source one end of which is connected to the first power source, a third transistor which is connected to the other end of the second current source, a fourth transistor which is connected between the third transistor and the second power source and includes a control electrode connected to the second current source, a first output point which is connected to the control electrode of the first transistor and a control electrode of the third transistor and outputs a first bias voltage, a second output point which is connected to the control electrode of the fourth transistor and the second current source and outputs a second bias voltage, and a bias voltage adjusting circuit which adjusts the first bias voltage in accordance with a control input; and an active load which is cascode connected and is controlled by the first bias voltage and the second bias voltage.

* * * * *